US005692626A

United States Patent [19]

Wehrle et al.

[11] Patent Number: 5,692,626

[45] Date of Patent: Dec. 2, 1997

[54] INTEGRAL DUAL COMPARTMENT CONTAINER

[75] Inventors: William R. Wehrle, Chapel Hill; Neil P. Stapensea, Raleigh, both of N.C.; Douglas J. Mattson, Liberty, Mo.; Ted E. Piatt, Apex, N.C.; Joseph P. Quinn, Whippany, N.J.

[73] Assignee: BASF Corporation, Mt. Olive, N.J.

[21] Appl. No.: 688,172

[22] Filed: Jul. 29, 1996

Related U.S. Application Data

[63] Continuation of Ser. No. 47,251, Nov. 30, 1995, Pat. No. Des. 378,191, which is a continuation of Ser. No. 37,718, Apr. 18, 1995, abandoned.

[51] Int. Cl.[6] ..... B65D 71/00

[52] U.S. Cl. ..... 215/6; 220/23.4; 220/524

[58] Field of Search ..... 215/6; 220/23.2, 220/23.4, 23.83, 500, 555, 524

[56] References Cited

U.S. PATENT DOCUMENTS

| | | | |
|---|---|---|---|
| D. 159,531 | 8/1950 | Polime . | |
| D. 192,980 | 6/1962 | Mangini et al. . | |
| D. 213,949 | 4/1969 | Lenhart . | |
| D. 230,708 | 3/1974 | Hutler . | |
| D. 236,315 | 8/1975 | Russo . | |
| D. 270,135 | 8/1983 | Gates . | |
| D. 270,237 | 8/1983 | Hestehave . | |
| D. 277,552 | 2/1985 | Küng . | |
| D. 280,599 | 9/1985 | Green . | |
| D. 284,641 | 7/1986 | Jones . | |
| D. 288,526 | 3/1987 | Parad . | |
| D. 292,268 | 10/1987 | Costa . | |
| D. 292,373 | 10/1987 | Costa . | |
| D. 305,982 | 2/1990 | Gillispie et al. . | |
| D. 314,510 | 2/1991 | Platte, Sr. . | |
| D. 319,970 | 9/1991 | Beeman . | |
| D. 326,606 | 6/1992 | Green . | |
| D. 333,263 | 2/1993 | Markuzov . | |
| D. 333,980 | 3/1993 | Schmitt . | |
| D. 346,113 | 4/1994 | Ferguson et al. . | |
| 423,650 | 3/1890 | Wilkins | 220/524 |
| 1,459,257 | 6/1923 | Reger | 220/524 |
| 2,826,338 | 3/1958 | Davis . | |
| 2,883,082 | 4/1959 | Schlumbohm . | |
| 3,756,470 | 9/1973 | Bagwell . | |
| 3,811,671 | 5/1974 | Turnbull . | |
| 4,010,863 | 3/1977 | Ebel . | |
| 4,125,207 | 11/1978 | Ernst et al. . | |
| 4,274,556 | 6/1981 | Thiessen . | |
| 4,294,372 | 10/1981 | Onishi . | |
| 4,509,639 | 4/1985 | Thompson | 220/23.4 X |
| 4,548,339 | 10/1985 | Gorman . | |
| 4,691,828 | 9/1987 | Slusarczyk et al. . | |
| 4,805,814 | 2/1989 | Allen, Sr. . | |
| 4,860,927 | 8/1989 | Grinde . | |
| 4,881,652 | 11/1989 | Schiemann . | |
| 4,889,255 | 12/1989 | Schiemann . | |
| 5,117,997 | 6/1992 | Fink . | |
| 5,301,829 | 4/1994 | Chrisco . | |

FOREIGN PATENT DOCUMENTS

| | | |
|---|---|---|
| 2149569 | 4/1973 | Germany . |

*Primary Examiner*—Steven M. Pollard
*Attorney, Agent, or Firm*—Nixon & Vanderhye P.C.

[57] ABSTRACT

An integral dual compartment container includes a pair of container bodies positioned back-to-back relative to one another. Each of the container bodies includes respective upper and lower container body portions. The upper body portions each has an opening and is asymmetrically disposed relative to the respective lower container body portions thereof. A handle spans the upper container body portions so as to establish a generally rectangular space therebelow. A pair of generally vertically oriented attachment flanges integrally attach a respective end of the handle to the upper container body portion, while a generally vertically oriented connecting flange extends continuously between the opposed rear walls of the container bodies and connects them in a back-to-back relationship.

6 Claims, 4 Drawing Sheets

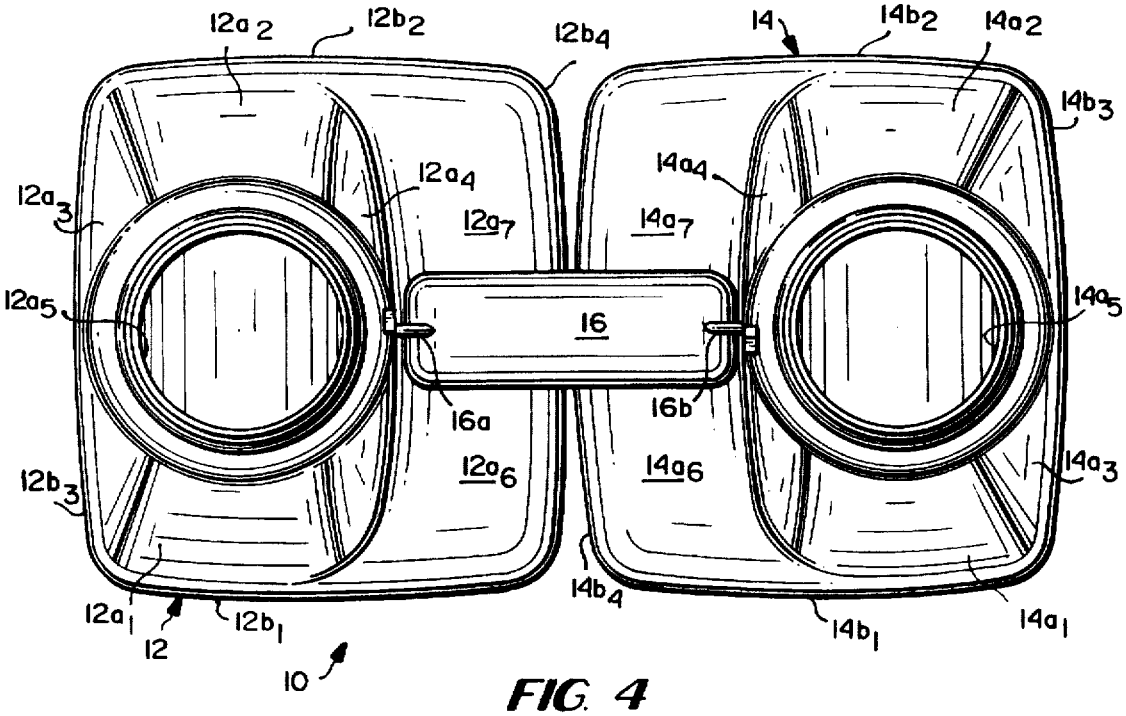
FIG. 4
FIG. 5
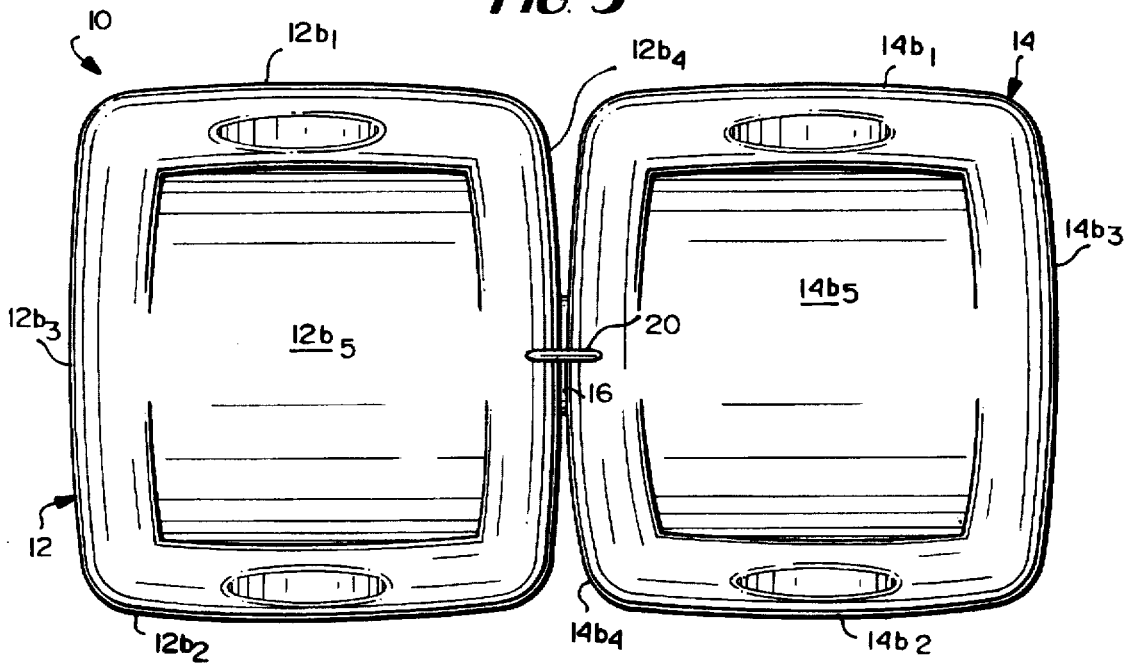

INTEGRAL DUAL COMPARTMENT CONTAINER

CROSS-REFERENCE TO RELATED APPLICATIONS

This application is a continuation of U.S. Design patent application Ser. No. 29/047,251 filed on Nov. 30, 1995 (now U.S. Pat. No. Des. 378,191), which in turn in a continuation of U.S. Design patent application Ser. No. 29/037,718 filed on Apr. 18, 1995 (abandoned), the entire content of each such prior filed application being incorporated expressly hereinto by reference.

BACKGROUND AND SUMMARY OF THE INVENTION

Dual compartment containers are, in and of themselves, well known as evidenced, for example, from U.S. Pat. Nos. Des. 270,237, Des. 346,113, Des. 270,135, Des. 314,510, Des. 333,263, Des. 292,268, Des. 288,526, Des. 159,531, Des. 326,606 and Des. 292,373.

According to the present invention, a novel integral dual compartment container is provided which includes a pair of container bodies positioned back-to-back relative to one another. Each of the container bodies includes respective upper and lower container body portions. Each of the upper body portions has an opening and is asymmetrically disposed relative to the respective lower container body portions thereof. A handle spans the upper container body portions so as to establish a generally rectangular space therebelow. A pair of generally vertically oriented attachment flanges integrally attach a respective end of the handle to the upper container body portion, while a generally vertically oriented connecting flange extends continuously between the opposed rear walls of the container bodies and connects them in a back-to-back relationship.

BRIEF DESCRIPTION OF THE DRAWINGS

Reference will hereinafter be made to the accompanying drawings wherein like reference numerals throughout the various FIGURES denote like structural elements, and wherein;

FIG. 4 is a top view of the integral dual compartment container shown in FIG. 1; and FIG. 5 is a bottom view of the integral dual compartment container shown in FIG. 1.

DETAILED DESCRIPTION OF THE PREFERRED EXEMPLARY EMBODIMENT

Figure 1:
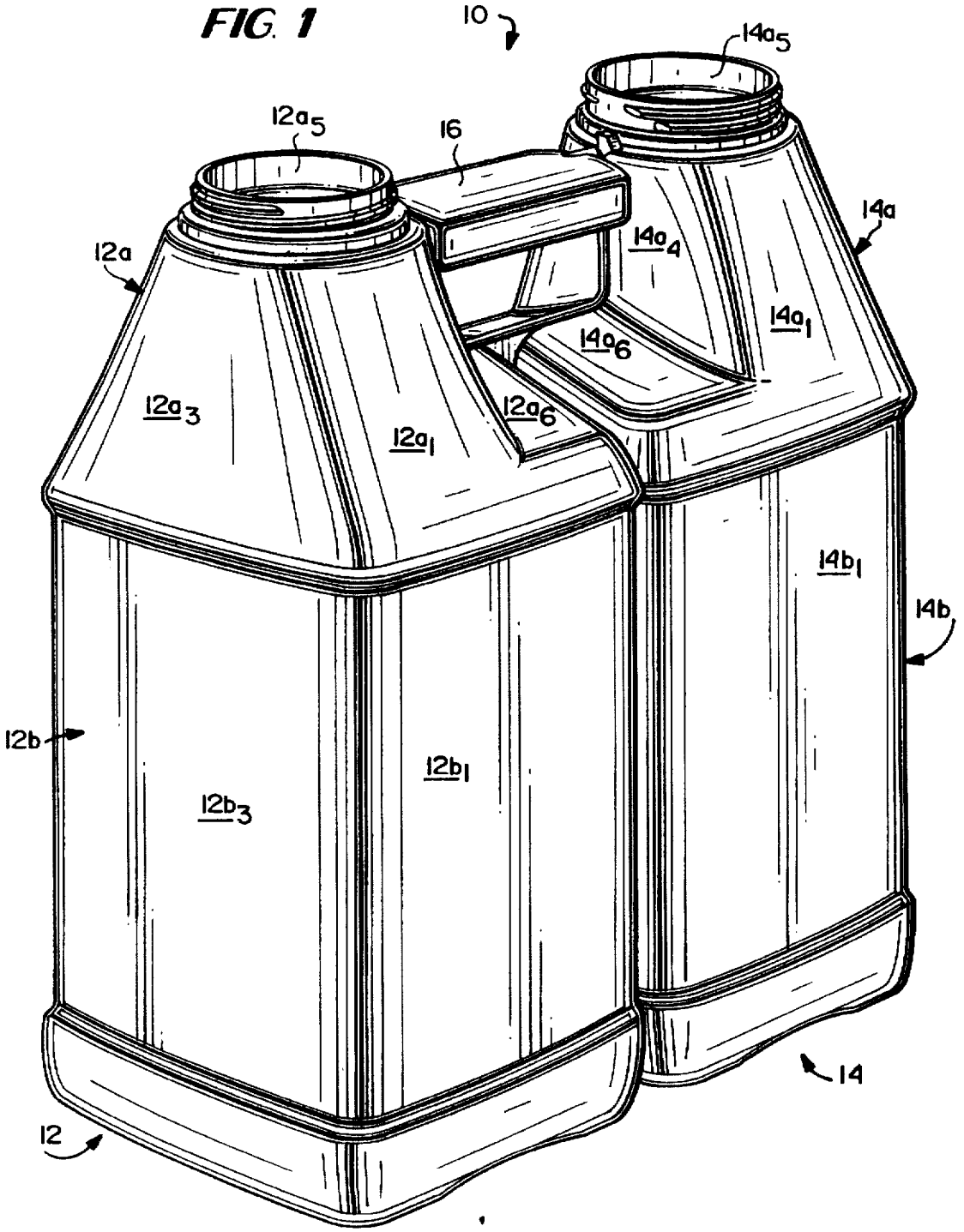
FIG. 1 is a front perspective view of the integral dual compartment container according to this invention.
Figure 2:
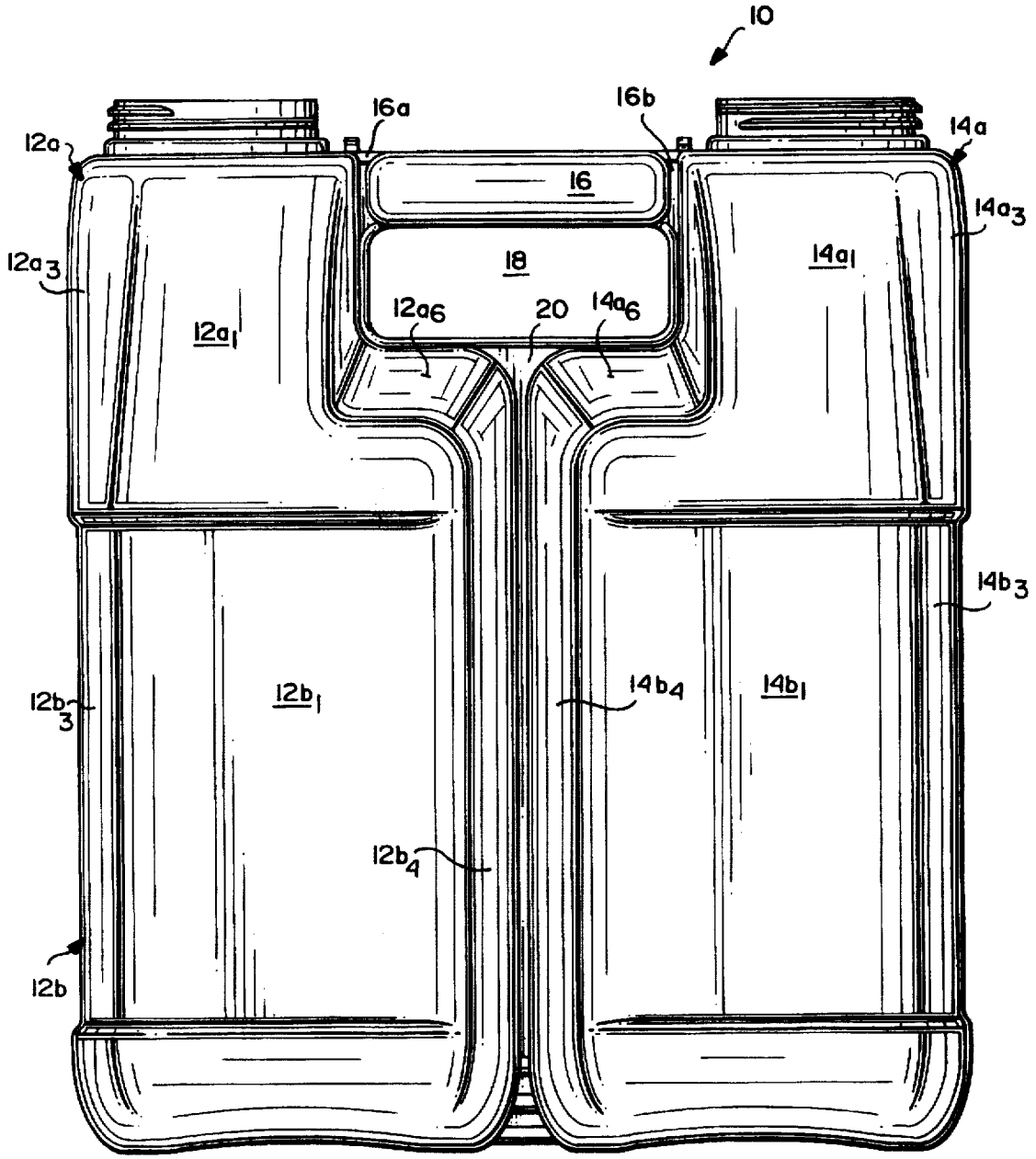
FIG. 2 is a front elevational view of the integral dual compartment container shown in FIG. 1.
Figure 3:
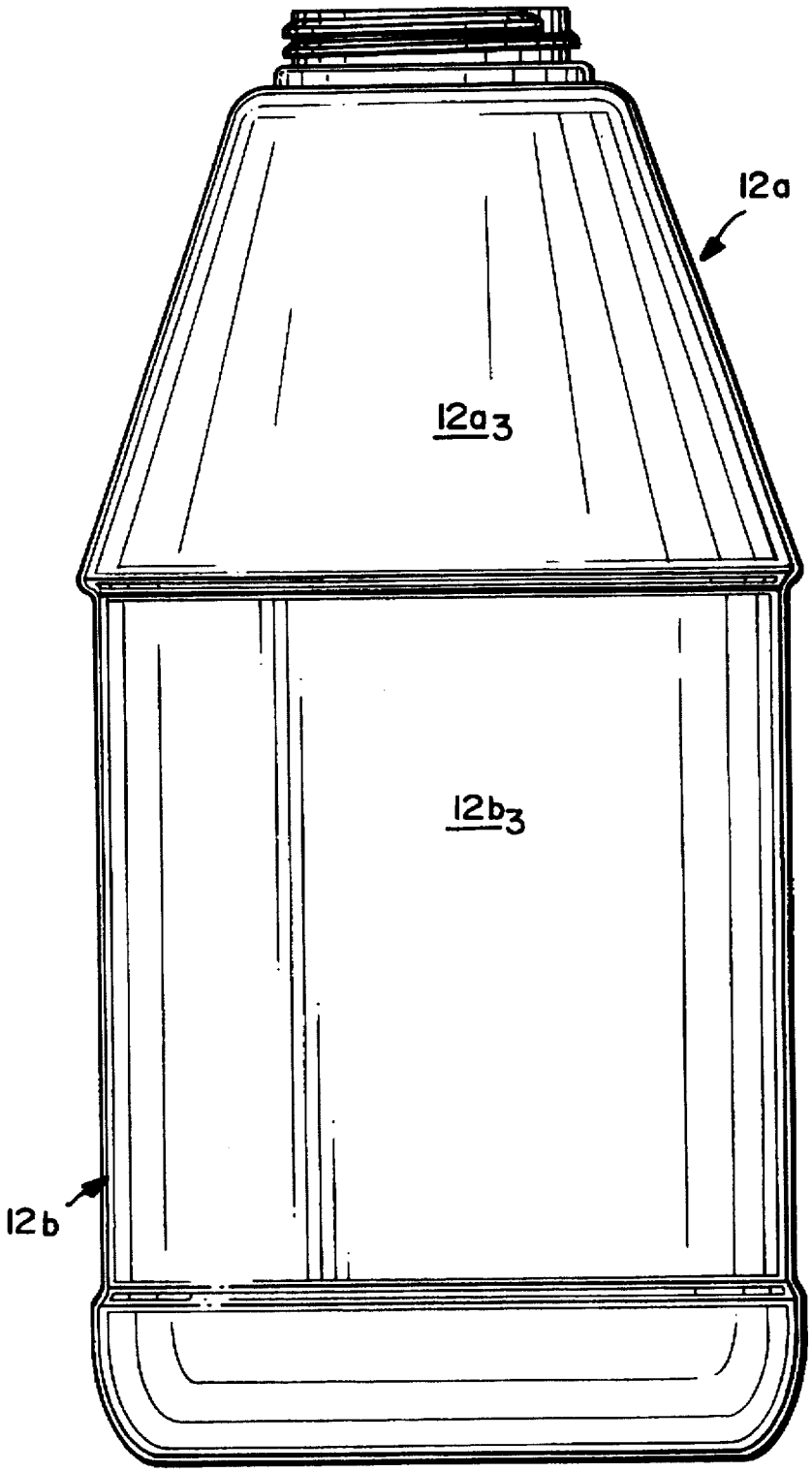
FIG. 3 is a right side elevational view of the integral dual compartment container shown in FIG. 1.

An exemplary integral dual compartment container 10 according to this invention is depicted in accompanying FIGS. 1–5. In this regard, it can be seen that the container 10 includes a pair of container bodies 12, 14 positioned back-to-back relative to one another. Each of the container bodies 12, 14 is provided with an upper container body portion 12*a*, 14*a* and a lower container body portion 12*b*, 14*b*, respectively.

Each of the lower body portions 12*b*, 14*b* is comprised of opposed a pair of generally vertical side walls $\mathbf{12}b_1$, $\mathbf{12}b_2$ and $\mathbf{14}b_1$, $\mathbf{14}b_2$, opposed generally vertical front and rear walls $\mathbf{12}b_3$, $\mathbf{12}b_4$ and $\mathbf{14}b_3$, $\mathbf{14}b_4$ and a bottom wall $\mathbf{12}b_5$, $\mathbf{14}b_5$, respectively. On the other hand, each of the upper body portions 12*a*, 14*a* is comprised of convergingly tapered walls $\mathbf{12}a_1$, $\mathbf{12}a_2$ and $\mathbf{14}a_1$, $\mathbf{14}a_2$, and generally vertical, but slightly convexly curved front and rear walls $\mathbf{12}a_3$, $\mathbf{12}a_4$ and $\mathbf{14}a_3$, $\mathbf{14}a_4$.

The upper container body portions 12*a*, 14*a* are most preferably asymmetrically disposed relative to their respective lower container body portions 12*b*, 14*b* and include respective openings $\mathbf{12}a_5$, $\mathbf{14}a_5$. As a result, pairs of downwardly sloping ledge walls $\mathbf{12}a_6$, $\mathbf{12}a_7$ and $\mathbf{14}a_6$, $\mathbf{14}a_7$ are provided in the upper container body portions 12*a*, 14*a*, respectively. A generally rectangularly shaped handle member 16 spans the distance between the walls $\mathbf{12}a_4$, $\mathbf{14}a_4$ of the upper container body portions 12, 14 and thereby defines a generally rectangular space 18 therebelow (see FIG. 2).

The handle 16 is joined integrally at each of its ends to the walls $\mathbf{12}a_4$, $\mathbf{14}a_4$ by generally vertically oriented attachment flanges 16*a*, 16*b*. Similarly, the container bodies 12, 14 are connected integrally to one another by a generally vertically oriented connecting flange 20 which extends continuously from the apex of walls $\mathbf{12}a_6$, $\mathbf{12}a_7$ and $\mathbf{14}a_6$, $\mathbf{14}a_7$ to the bottom walls $\mathbf{12}b_5$, $\mathbf{14}b_5$.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An integral dual compartment container comprising:

a pair of container bodies positioned back-to-back relative to one another, each of said container bodies including respective upper and lower container body portions;

a generally vertically oriented connecting flange which extends continuously between opposed rear walls of said back-to-back pair of container bodies so as to integrally connect said pair of container bodies one to another along a vertical midplane of said container;

each of said upper body portions of said container bodies having an opening which is asymmetrically disposed relative to said respective lower container body portion thereof;

each said upper body portion includes (i) an opposed pair of convergingly tapered side walls, (ii) an opposed pair of generally vertical front and rear walls, and (iii) an opposed pair of ledge walls connected integrally to said rear wall of said upper body portion and sloping downwardly from said vertical midplane of said container; and a handle spanning said upper container body portions and spaced above said ledge walls thereof so as to establish a generally rectangular void space therebelow.

2. The container of claim 1, further comprising:

a pair of generally vertically oriented attachment flanges for integrally attaching a respective end of said handle to said upper container body portions.

3. The container of claim 1, wherein each of said lower body portion is comprised of a bottom wall, a pair of opposed generally vertical front and rear walls and an opposed pair of generally vertical side walls.

4. The container of claim 3, further comprising a generally vertically oriented connecting flange which extends continuously between said rear walls of said back-to-back pair of container bodies.

5. The container of claim 1, wherein each of said front and rear walls of said upper body portions is slightly convexly curved.

6. The container of claim 1, 2, 3, 4 or 5, wherein said opening of each of said upper body portions lies in a horizontally oriented plane.

* * * * *